United States Patent [19]

Toba et al.

[11] 4,006,208

[45] Feb. 1, 1977

[54] PROCESS FOR MANUFACTURING ELASTIC HARD FIBERS

[75] Inventors: Hirotaka Toba; Keiichi Ohata; Nagayoshi Tsukane, all of Saitama, Japan

[73] Assignee: Daicel, Ltd., Osaka, Japan

[22] Filed: Oct. 16, 1975

[21] Appl. No.: 622,953

Related U.S. Application Data

[63] Continuation of Ser. No. 370,968, June 18, 1973, abandoned.

[30] Foreign Application Priority Data

June 22, 1972 Japan ..... 47-62722

[52] U.S. Cl. ..... 264/176 F; 264/178 F; 264/210 F

[51] Int. Cl.[2] ..... D01D 5/08

[58] Field of Search ..... 260/2 A; 264/176 F, 264/178 F, 210 F

[56] References Cited

UNITED STATES PATENTS

| | | | |
|---|---|---|---|
| 3,408,435 | 10/1968 | Logan et al. | 264/176 F |
| 3,432,590 | 3/1969 | Papps | 264/210 F |
| 3,453,357 | 7/1969 | Logan | 264/236 |
| 3,509,074 | 4/1970 | Kamio et al. | 260/2 A |

FOREIGN PATENTS OR APPLICATIONS

| | | | |
|---|---|---|---|
| 43-5180 | 2/1968 | Japan | 264/176 F |

*Primary Examiner*—Jay H. Woo

*Attorney, Agent, or Firm*—Woodhams, Blanchard and Flynn

[57] ABSTRACT

An elastic hard fiber composed mainly of polyisobutylene oxide and having an elastic recovery ratio of at least 70% from 50% extension and a work recovery ratio of at least 70% from 5% extension, is prepared by extruding molten polyisobutylene oxide at a temperature of from 175° C up to the decomposition temperature thereof, cooling the extrudate rapidly to a temperature of −20° to 70° C, and spinning it at a draw ratio of 50 to 1000.

9 Claims, 2 Drawing Figures

PROCESS FOR MANUFACTURING ELASTIC HARD FIBERS

This is a continuation, of application Ser. No. 370,968, filed June 18, 1973, and now abandoned.

BACKGROUND OF THE INVENTION

Field of the Invention

This invention relates to elastic hard fibers composed mainly of polyisobutylene oxide and which have an extremely high work recovery ratio, and to elastic hard fibers which have in combination a highly elastic behavior and a high work recovery ratio, and to a process for manufacturing such elastic hard fibers.

Most fibers have inherent elastic properties and they exhibit an elastic recovery property such that when they are deformed by an externally applied stress, for example, when they are elongated by a tensile stress, and the stress is then removed, they tend to return to their original configuration. Among the various properties of fibers, one of the properties of high practical value in connection with recovery from shrinkage, creasing or wrinkles, is that the fibers have a high elastic behavior and a high work recovery ratio when applied stress is removed. It is reported that among the commercially available fibers, nylon fibers possess the most excellent elastic recovery characteristics. It is reported that, for example, 210 denier nylon yarns exhibit an initial recovery ratio of 78% and an overall recovery ratio of 95% from 30 – 50% extension (see "Synthetic Fibers," pages 157 and 783 written by Sakurada, Sofue, and Kushii and published by Asakura Shoten). The initial recovery ratio means the elastic recovery ratio immediately after the fibers are taken up and the overall recovery ratio means the elastic recovery ratio after when the fiber is maintained at a predetermined length for a predetermined period and is then relaxed and allowed to stand still for a sufficiently long time (e.g. 24 hrs.).

However, when most fibers are stretched or elongated, a considerable plastic deformation occurs and they are unable to return completely to their original length. Further, when extension and relaxation are repeated, strain is left in the fibers and they are likely to be stretched considerably or to be broken.

Elastomer fibers are mentioned as an example of fibers having a high elastic recovery ratio. Typical examples of such fibers are Spandex fibers. According to the regulations of the United States Tariff Commission, it is specified that Spandex fibers are those in which "chains containing urethane linkages occupy at least 80% of the chemical structure constituting the fibers". In practice, these fibers exhibit a considerable elastic recovery ratio after 500 – 700% extension. A typical process for the manufacture of such Spandex fibers comprises synthesizing a diisocyanate and a cyclic ether, respectively, polymerizing the cyclic ether, polycondensing both the terminal groups of the polymerized cyclic ether with excess diisocyanate groups to form a prepolymer, and spinning it into a coagulation bath by the wet or dry method.

Thus, this process comprises a number of steps and the manufacturing cost of such fibers is very high. Further, these fibers have the defects that yellowing thereof readily occurs and body odor is likely to become present in the fibers. Accordingly, development of elastic fibers having a high elastic recovery ratio which can be manufactured at a low cost by a simple spinning method has heretofore been greatly desired in the art.

Recently, fibers of high elastic characteristics, called "elastic hard fibers", have been developed. For example, Japanese Patent Publication No. 9810/66 discloses a process for the manufacture of polypivalolactone fibers.

However, commercial utilization of polypivalolactone fibers has not succeeded because of the complicated procedures required for the synthesis of the monomers and because of the inherent instability of the lactone units against heat, acids, alkalis and the like.

In "Journal of Macromolecular Science, *B5* (4), p. 721 (1971)", R. G. Quynn and H. Brody describe elastic hard fibers made of polypropylene, poly-3-methylbutene-1 and polyoxymethylene. They state that although the mechanism of the highly elastic behaviors of these fibers has not sufficiently been elucidated as yet, the high elasticity of these fibers is deemed not to depend on the classical theory of rubber elasticity or the change in entropy; rather it is considered to be due to accumulated crystalline lamellas.

The "hardness" of elastic fibers referred to herein means a hard elasticity owing to the semimicroscopic states of the crystalline and amorphous portions of the fibers and it is not caused by a simple change in entropy such as is the case in the conventional elastic fibers. Said "hard elasticity" can be clearly distinguished from "soft hardness" in the conventional elastic fibers. The fundamental difference is apparent from the stress-strain curves shown in FIG. 1.

More specifically, FIG. 1 shows a stress-strain curve I of a typical elastic hard fiber, i.e. poly-3-methylbutene-1 fiber (plotted based on values given by Quynn et al. in "Journal of Macromolecular Science," *B5*, p. 721 (1971) and a stress-strain curve II of a typical elastic soft fiber, i.e., a Spandex fiber. As is apparent from FIG. 1, under the same extension, in the elastic soft fiber II the stress is extremely low as compared with the case of the elastic hard fiber I. For instance, under 50% extension, in a typical elastic soft fiber, i.e., a Spandex fiber, the stress is 0.03–0.04 g/denier (25° C) but an elastic hard fiber has a stress more than 10 times as high. (For example, as is seen in FIG. 2 which illustrates the stress-strain curve drawn continuously and repeatedly with respect to the elastic hard fiber of polyisobutylene oxide manufactured by the process of this invention, the elastic fiber of this invention has a stress of 0.7–1.5 g/denier under the same elongation.)

We noted that these elastic hard fibers have in common with each other the characteristic that they are highly crystalline, high molecular substances and they have small regular branches (polyoxymethylene has regular hydrogen bonds which are considered to exhibit the same function as the branches). We studied polyisobutylene oxide which is a highly crystalline, high molecular weight polymer, despite the presence therein of polyether branches, in relation to the inherent rubbery elasticity of polyethers such as polyethylene oxide, polypropylene oxide and polyepichlorohydrin. Thus, we carried out our research with a view to developing elastic characteristics and behaviors in polyisobutylene oxide, and as a result, we discovered the present invention.

SUMMARY OF THE INVENTION

It is therefore a primary object of this invention to provide an elastic hard fiber composed mainly of polyisobutylene oxide, which fiber has a work recovery ratio of at least 70% after 5% extension and an elastic recovery ratio of at least 70% after 50% elongation, and to provide a process for manufacturing such fibers on an industrial scale.

DETAILED DESCRIPTION OF THE INVENTION

Figure 1:
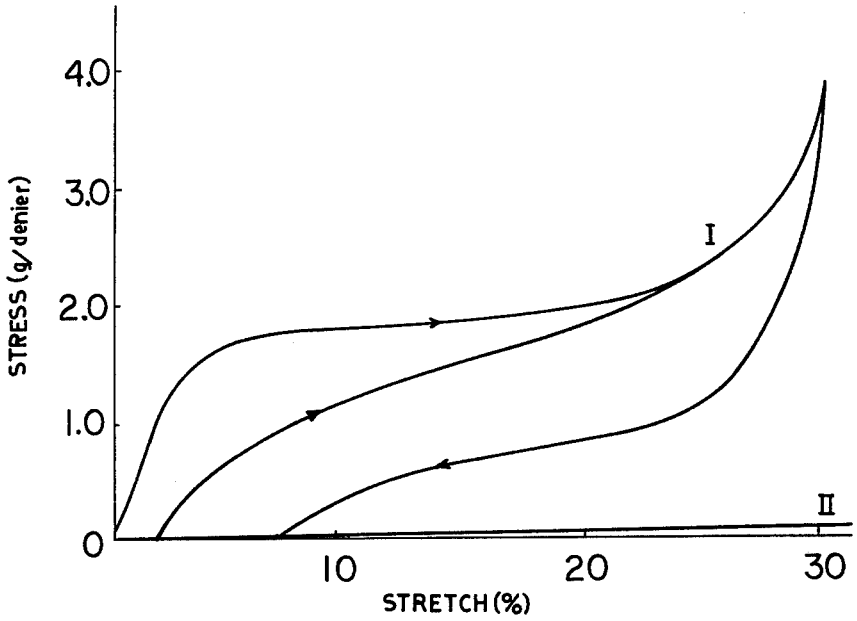
FIG. 1 illustrates stress-strain curves of prior art elastic hard fibers and elastic soft fibers.

Isobutylene oxide monomer can readily be prepared by reacting isobutylene, which is a typical component of the $C_4$ fraction formed in large amounts in the petrochemical industry, with a peroxide. A highly polymerized polyisobutylene oxide can be obtained in a high yield by polymerizing this monomer in the presence of an organic metal compound as catalyst.

Thus, this polymer can be obtained in great quantity and at low cost, and it is very suitable as a polymer material for a wide variety of applications.

Polyisobutylene oxide fibers are known in the art and they can be prepared by melt spinning according to a method such as that disclosed in Japanese Patent Publication No. 12180/65. This Patent Publication, however, gives no disclosure concerning the elastic behavior of such fiber. When the spinning is carried out at 100°–190° C as disclosed in said Patent Publication, it is impossible to obtain elastic hard fibers which exhibit adequate elastic behavior.

Shigenobu Mihashi succeeded in obtaining, prior to this invention, films of polyisobutylene oxide having a high elastic recovery ratio under extensions of up to 50% by rapidly cooling a melt of polyisobutylene oxide in liquid nitrogen, stretching it at a stretch ratio of 5 and heat-treating it in vacuo at 165° C, for 1 hour [Kogyo Kagaku Zasshi, 72, page 2159 (1969)].

However, this method includes steps which are very difficult to practice on an industrial scale, such as the rapid cooling in liquid nitrogen and the heat treatment in vacuo under tension. In this method, it is essential to conduct the rapid cooling of the melt and the heat treating step while maintaining the film length constant. Thus, the steps of this method are very complicated and the practice of this method on an industrial scale involves various difficulties and disadvantages.

With a view to obtaining elastic hard fibers of polyisobutylene oxide having an elasticity recovery ratio of at least 70%, preferably at least 90%, from 50% extension, we carried out intensive research, and discovered the process of this invention. This process can be practiced very easily by simple operations and it has high industrial value.

More specifically, the process for the manufacture of elastic hard fibers of polyisobutylene oxide according to this invention comprises extruding molten polyisobutylene oxide at a temperature in the range of from 175° C up to the decomposition temperature of the polybutylene oxide, through orifices of an extrusion molding apparatus or a melt spinning apparatus, and cooling the extrudate rapidly in a water or air bath maintained at −20° to 70° C, preferably 10° to 30° C, and spinning it at a draw ratio of 50 to 1000, preferably 300 to 500. As detailed hereinafter, the cooling conditions during the melt spinning and the draw ratio both are critical in this invention. The reason why these factors should be limited within the above-mentioned ranges will be apparent from the results of examples and comparative examples given hereinafter.

In the process of this invention, the wind-up rate of the filament varies depending on the diameter of the spinning orifice, the polymer extrusion rate and other factors, but the wind-up rate is generally from 10 to 700 m/min, preferably 20 to 300 m/min. It is preferred that there be provided a spacing of at least 1.5 meter between the spinneret and the winding apparatus. As it moves through that distance the extrudate should be maintained under tension and treated at the prescribed temperature.

The term "draw ratio" referred to herein means the amount of stretching or elongation of the filament which takes place, caused by the difference in speed between (1) the wind-up speed of the filament at the spinning step (also called the "spinning speed", which latter term has the same meaning as the term "wind-up speed" referred to in this description) and (2) the flow speed of the polyisobutylene oxide spinning solution issuing from the orifice of the spinneret. The endless extrudate (filament) thus undergoes elongation during its travel from the spinneret to the take-up apparatus. The "draw ratio" is expressed by the following formula:

Draw ratio = (wind-up speed of the filament)/(flow speed of spinning solution). The flow speed of the spinning solution is calculated from the following formula:

$$V_0 = 4Q/\pi ND^2$$

wherein $V_0$ designates the flow speed (m/min), Q stands for the feed rate (cc/min) of the spinning solution to the orifice caused by the spinning pump, D designates the orifice diameter (mm) of the spinneret and N indicates the number of orifices.

It is well known in the art that the physical properties of fibers can be changed somewhat by varying the cooling temperature and the stretching rate or draw ratio. However, it is quite a surprising fact, which is not obvious from conventional techniques, that fibers having highly elastic characteristics can be obtained by a simple method comprising spinning the extrudate under tension and under the prescribed draw ratio conditions while cooling it at a temperature approximating room temperature.

Prior to this invention, insofar as we are aware, no reports have been made on the elastic behaviors of polyisobutylene oxide fibers. Elastic hard fibers of polyisobutylene oxide which can be manufactured on an industrial scale have been developed for the first time by this invention.

In the process of this invention for the manufacture of elastic hard fibers, the draw conditions and the cooling conditions both are critical. When the draw ratio is too low or too high, the resultant fibers exhibit mainly a plastic flow when tensioned and thus they are irreversibly elongated to an excessive extent. As a result, the elastic recovery ratio is below the range of values sought in this invention. There is a very delicate balance between the cooling condition and the drafting condition, and the properties of the resulting elastic fibers are greatly changed by a slight variation in these conditions. This finding on the elastic behavior of the fiber is one of the important features of this invention.

In this invention, the cooling step is critical. The conditions for effecting this cooling are readily practiced in commercial spinning operations.

In general, it is possible to obtain resinous products having varying physical properties, by cooling the starting crystallizable high molecular polymer substance at such a temperature gradient (cooling rate) that the optimum crystallization temperature $T_0$ is rapidly passed, thereby to form incomplete crystals or to reduce the degree of crystallization.

In contrast, the cooling step employed in the process for the manufacture of polyisobutylene oxide elastic fibers according to this invention can be accomplished very easily by passing the extruded filaments through a flowing air or water bath maintained, for example, at a temperature very close to room temperature, such as 10° to 30° C, and positioned at a distance of from 5 to 30 cm from the spinneret. The extruded filaments can be rapidly cooled to a temperature of −20° to 70° C, preferably 10° to 30° C, by passing them in a water or air maintained at such temperature.

Accordingly, the cooling step of this invention is very simple. It cannot be considered that the fine crystalline structure of polyisobutylene and its degree of crystallization are greatly changed by the cooling step according to this invention. In fact, the X-ray diffraction patterns of elastic fibers and non-elastic fibers of polyisobutylene oxide do not show a great difference in the crystal structure or crystallization degree.

In this invention, only the cooling and spinning is conducted under tension. In principle, no stretching or drawing of the filament is effected during the subsequent steps after taking up the filament. When the fibers are heat-treated at 90° – 165° C for 1 – 24 hours in a heater or boiling water, in general, the initial elastic recovery ratio thereof is reduced and also the initial elasticity is reduced, and thus the fibers have a soft feel. However, under some cooling conditions, the elastic recovery ratio is increased after such heat treatment. Thus, the influences of such heat treatment are not capable of simple definition, because they will vary depending on the drafting and cooling conditions.

The method for measuring the elastic recovery ratio after 50% extension, employed in this invention, is one commonly employed for testing fibers. According to this method, the elastic recovery ratio is determined based on the stress-strain curve of the fiber sample. More specifically, a fiber sample having a length of 50 mm is stretched at a rate of 100 mm/min until the length of the fiber sample is elongated by 50% of its original length, then the fiber is maintained at this 50% extension state for 1 minute, and then the fiber is allowed to retract at a rate of 100 mm/min. The clamps are removed and the fiber is allowed to stand still for 5 minutes. Then, the fiber is reclamped, slack is taken up and then the stretching and relaxation are repeated in the same manner as above, and the fiber is allowed to stand still for a prescribed period of time. Then, the fiber length is measured and the elastic recovery ratio is calculated.

In the calculation of the elastic recovery ratio, the following formula applicable to Spandex elastic fibers, disclosed in Japanese Patent Publication No. 7885/66, is employed:

$$\text{Elastic recovery ratio (\%)} = \frac{1.5a - b}{0.5a} \times 100 \qquad (1)$$

wherein $a$ is the length of the starting fiber sample measured when the sample is uniformly elongated to take up slack, but no stress is applied thereto, and $b$ is the length of the fiber sample measured after completion of the above-described test method, wherein after the second relaxation the fiber sample is allowed to stand still under no tension for 10 hours and then is uniformly elongated under no stress to take up slack and then its length is measured.

As one of characteristic properties of the elastic hard fibers of this invention, there is mentioned its high initial elastic recovery ratio.

Figure 2:
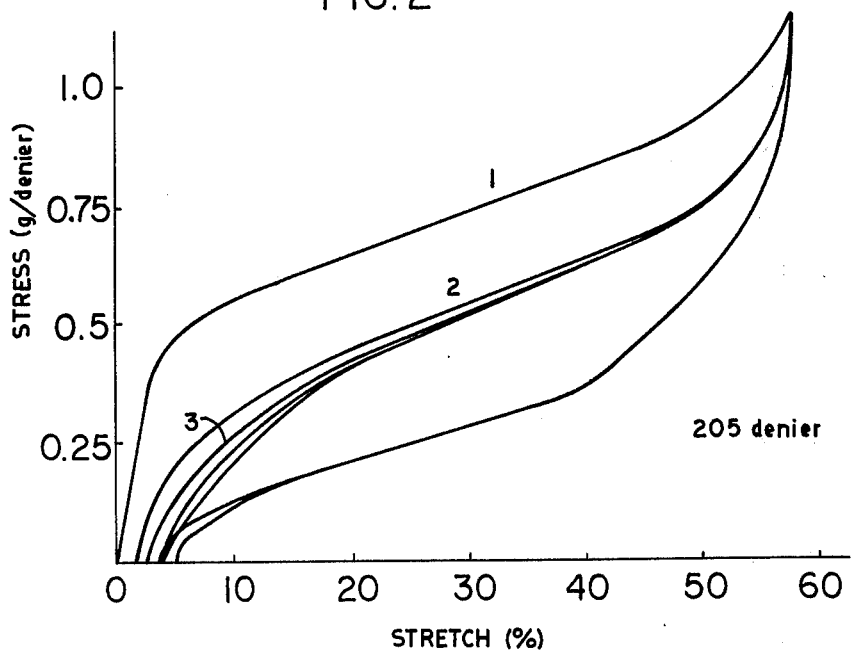
FIG. 2 illustrates a stress-strain diagram of an elastic hard fiber according to this invention.

As pointed out above, FIG. 2 illustrates the stress-strain diagram obtained when the elastic hard fiber of this invention is elongated and relaxed repeatedly. The initial elastic recovery ratio after extension (the value of the ratio of (1) elastic extension, i.e. the part recovered when the stress is removed, to (2) the total extension imparted to the fiber sample, expressed in percent,) is 95% or more for every repetition of extension and relaxation. After the extension and relaxation are repeated about 7 times, the value of the initial elastic recovery ratio approximates 98%. The polyisobutylene oxide elastic fibers, according to this invention, have an initial elastic recovery ratio, from 50% extension, of at least 70%, preferably at least 80%, and still more preferably at least 90%.

The term work recovery ratio from 5% elongation, referred to in this description means the ratio, expressed in percent, of $$\frac{\text{work returned during relaxation}}{\text{total work done in extension}}$$

It is the ratio of (1) the area below the relaxation curve of the stress-strain diagram from 5% extension, to (2) the area below the elongation curve of the same stress-strain diagram. This value is measured after the second extension operation onward. The polyisobutylene oxide elastic fibers of this invention have a work recovery ratio from 5% extension of at least 70%, and preferably, this value exceeds 85%. Thus, the polyisobutylene oxide fibers of this invention have a very high work recovery ratio.

The polyisobutylene oxide employed to make the fibers in this invention include homopolymers, copolymers and polymer blends in which at least 60% of the repeating structural units of the polymer are isobutylene oxide monomer units. The polyisobutylene oxide has an inherent viscosity of from 0.8 to 50, as measured by employing a solution of 0.1 g of the polymer dissolved in 100 ml of o-dichlorobenzene, by means of an Ostwald viscometer. It should be preferably in the range of from 0.8 to 15.

Many features relating to the elastic behaviors of the fibers of this invention have not been elucidated as yet. For instance, it may be considered that such elastic behaviors are due to inclination or bending of lamellas arranged vertically to the fiber axis, entanglements of branches formed prior to completion of the crystal structure or due to transformation of crystal structure or voids formed in incomplete crystals. However, based on the presently available data, the mechanism cannot be elucidated completely.

It is, however, presumed that it is not the fine structure of crystals, but rather it is the semi-fine structure, that determines the mechanism of the elastic behavior.

The polyisobutylene oxide fibers of this invention have a rather low density which is in the range of from 1.020 to 1.065. Further, they are characterized by a rather high birefringence, which is a measure of the degree of orientation of crystals and is measured by a Berek compensator using Na-D ray as the light source. The birefringence values of the polyisobutylene oxide fibers of the present invention ($\Delta n \times 10^{-3}$) are in the range of from 25 to 100, preferably 30 to 70.

Since the polyisobutylene oxide fibers of this invention exhibit a high recovery from wrinkles, compression, stretching and the like, they have great utility in the fields of woven and non-woven fabrics. They can be mixed or woven with other fibers for use in the fields in which conventional Spandex fibers are used. They also are used effectively in fields where their hardness is highly advantageous, for instance, as reinforcements or packing materials for carpets, brushes, sleeping bags and the like.

This invention will now be further described by reference to the following illustrative examples, but the scope of this invention is not limited by these examples.

EXAMPLE 1

Molten polyisobutylene oxide having an inherent viscosity of 2.5 and containing 0.8% by weight of tetrakis-[methylene-3-(3,5-di-tertiary-butyl-4-hydroxyphenyl)propionate]-methane and 0.2% by weight of 4-4'-thiobis-(3-methyl-6-tertiary-butylphenol) was melt-extruded at 210° C from nozzles of an extrusion molding machine through orifices having a diameter of 1 mm at a flow speed of about 0.185 m/min. The extruded filaments were rapidly cooled in a flowing air bath maintained at 10° C and disposed at a distance of 5 cm below the nozzles. The filaments were wound at a rate of 50 m/min by means of a winding apparatus disposed at a distance of 3 m from the spinning nozzles. The filaments were stretched at the spinning nozzles and also were stretched 2 – 3 times their original length during the solidification passage from the nozzles to the winding apparatus, this stretch ratio corresponding to a draw ratio of 270.

The thus-obtained elastic hard fibers had a size of 250 denier. The elastic recovery ratio from 50% extension was 92% as the initial elastic recovery ratio and rose to 96.5% after 10 hours. The fibers were also characterized by a work recovery ratio from 5% extension of 92%, a breaking strength of 0.91 g/d, an elongation at break of 120% and a stress at 50% extension of 0.69 g/d. The fiber density was 1.0468 and the birefringence was 30.

COMPARATIVE EXAMPLE 1

The same polyisobutylene oxide composition as used in Example 1 was melt-extruded, employing the same apparatus, but without conducting the special cooling and the filaments were wound on a winding apparatus spaced 3 m from the nozzles. The draw ratio during this operation was 1200. Although the resulting fibers had a breaking strength of 4.3 g/d, they underwent plastic deformation when stressed and did not exhibit a significant elastic recovery after extension. The fiber density was 1.0685.

EXAMPLE 2

Polyisobutylene oxide having an inherent viscosity of 1.7 and containing the same additives as those contained in the polymer composition of Example 1 was melt-extruded at 210° C, from a spinneret having 20 orifices of an orifice diameter of 0.7 mm. The extruded filaments were moved in contact with a cooling roll having a surface temperature of about −15° C and were wound at a rate of 170 m/min by means of a winding apparatus spaced 2.5 m from the spinning nozzles. The draw ratio was 800 in this operation.

The thus-obtained elastic hard fibers had a size of 15 denier, an initial elastic recovery ratio from 50% extension of 89%, which increased to an elastic recovery ratio of 96% after 10 hours. The work recovery ratio from 5% extension was 88%, the breaking strength was 1.2 g/d, the elongation at break was 150% and the stress under 50% extension was 0.67 g/d. When the fibers were allowed to stand still for 30 minutes below an iron maintained at 130° C, no particular change in the filament properties occurred, except that the work recovery ratio increased to 92%. When the thus-obtained fibers were elongated at 50% and allowed to stand still for 5 minutes or 1 hour, the elastic recovery ratio was 96% in both cases and no difference was observed. The fiber density was 1.0273 and the birefringence was 33.

COMPARATIVE EXAMPLE 2

The same polyisobutylene oxide composition as used in Example 2 was spun at a draw ratio of about 300 by means of the same apparatus as used in Example 2 while the fibers were maintained in hot air of 90° C during their passage through a zone spaced 1.5 m from the extrusion nozzles, and then wound on a winding apparatus spaced 5 m from the extrusion nozzles.

The resulting fibers were elongated under stress and they did not exhibit any elastic recovery power. The birefringence of the fibers was 16.

EXAMPLE 3

Polyisobutylene oxide having a reduced viscosity of 2.5 and containing 0.9% by weight of Irganox 1010 (stabilizer manufactured by Ciba-Geigy) and 0.2% by weight of an antioxidant manufactured by the same company was melt-extruded at a temperature of 210° C, employing the same apparatus as used in Example 2. A bundle of the extruded filaments was cooled in a flowing air bath having a temperature of 50° – 60° C and disposed about 10 cm below the extrusion nozzles and then was wound on a winding apparatus spaced about 5 m from the extrusion nozzles. The draw ratio was 70.

The thus-obtained elastic hard fibers had a size of 21 denier, an initial elastic recovery ratio from 50% extension of 78%, which increased to an elastic recovery ratio of 85% after 10 hours, a work recovery ratio from 5% extension of 82%, a breaking strength of 1.1 g/d, an elongation at break of 135% and a stress under 50% extension of 0.78 g/d. The fiber density was 1.0486.

COMPARATIVE EXAMPLE 3

The same polyisobutylene oxide as used in Example 3 was melt-extruded and wound, employing the same apparatus as used in Example 3, while cooling the extruded filaments in an air bath maintained at 15° C. The draw ratio was about 30.

The resulting filaments exhibited a plastic deformation and had scarcely any elastic recovery power after elongation. The birefringence of the filaments was 24.

COMPARATIVE EXAMPLE 4

By employing the same apparatus as employed in Example 3, the same polyisobutylene oxide as used in Example 3 was spun and wound at a rate of about 15 m/min while the extruded filaments was contacted with a cooling roll, the surface of which was maintained below −40° C by passing a cooling medium cooled by dry ice-methanol (−78° C) through the interior of the roll. The draw ratio was 110. In this case filaments having excellent transparency were obtained, and they had a breaking strength of 1.3 g/d and an elongation at break of 480% but they had no elastic recovery power.

EXAMPLE 4

Molten polyisobutylene oxide having an inherent viscosity of 12.5 and containing 0.8% by weight of tetrakis-[methylene-3-(3,5-di-tertiary-butyl-4-hydroxyphenyl)propionate]-methane and 0.2% by weight of 4-4'-thiobis-(3-methyl-6-tertiary-butylphenol) was melt-extruded at 258° C from nozzles of an extrusion molding machine through orifices having a diameter of 1 mm. The extruded filaments were rapidly cooled in a flowing air bath maintained at 25° C and disposed at a distance of 5 cm below the nozzles. The filaments were wound at a rate of 65 m/min by means of a winding apparatus disposed at a distance of 3 m from the spinning nozzles. The filaments were stretched at the spinning nozzles and also were stretched 2 –3 times their original length during the solidification passage from the nozzles to the winding apparatus, this stretch ratio corresponding to a draw ratio of 300.

The thus-obtained elastic hard fibers had a size of 235 denier. The elastic recovery ratio from 50% extension was 90% as the initial elastic recovery ratio and rose to 96% after 10 hours. The fibers were also characterized by a work recovery ratio from 5% extension of 90%, a breaking strength of 1.2 g/d an elongation at break of 145% and a stress at 50% extension of 0.71 g/d.

The embodiments of the invention in which an exclusive property or privilege is claimed are defined as follows:

1. A process of forming an elastic polyisobutylene oxide filament, which comprises:

melt extruding a molten filament-forming isobutylene oxide polymer composition at a temperature in the range of from 175° C up to the decomposition temperature of polyisobutylene oxide into a filament, at least 60% of the repeating structural units of the polymer being isobutylene oxide monomer units;

stretching the molten filament issuing from the spinneret orifice at a draw ratio of from 50 to 1000, wherein draw ratio is defined as the wind-up speed of the filament divided by the flow speed of the molten polymer composition issuing from the spinneret orifice;

quenching the filament to a temperature of from −20° C to +70° C within a short distance of the spinneret orifice and prior to winding up the filament; and winding up the filament, said filament as wound up having an elastic recovery ratio of at least 70% from 50% extension and a work recovery ratio of at least 70% from 5% extension.

2. A process according to claim 1 in which the draw ratio is from 300 to 500.

3. A process according to claim 1 in which the quenching step comprises continuously moving the filament under tension through a cooling zone spaced a distance of from 5 to 30 cm from the spinneret orifice.

4. A process according to claim 3 in which the cooling zone comprises a flowing air or water bath maintained at a temperature of from 10° to 30° C.

5. A process according to claim 1 in which the filament is wound up under tension on a take-up device spaced at least 1.5 meters from the spinneret orifice.

6. A process according to claim 5 in which the filament is wound up at a speed of from about 10 to 700 m/min.

7. A process according to claim 5 in which the filament is wound up at a speed of from about 20 to 300 m/min.

8. A process according to claim 1 in which said polyisobutylene oxide has an inherent viscosity of 0.8 to 50.

9. A process according to claim 1 in which said polyisobutylene oxide has an inherent viscosity of 0.8 to 15.

* * * * *